US011548124B2

(12) United States Patent
Ho

(10) Patent No.: US 11,548,124 B2
(45) Date of Patent: Jan. 10, 2023

(54) PNEUMATIC WRENCH

(71) Applicant: YUEH-CHI ENTERPRISE CO., LTD., Taichung (TW)

(72) Inventor: Chuan-Cheng Ho, Taichung (TW)

(73) Assignee: YUEH-CHI ENTERPRISE CO., LTD., Taichung (TW)

( * ) Notice: Subject to any disclaimer, the term of this patent is extended or adjusted under 35 U.S.C. 154(b) by 387 days.

(21) Appl. No.: 16/996,539

(22) Filed: Aug. 18, 2020

(65) Prior Publication Data

US 2021/0205966 A1 Jul. 8, 2021

(30) Foreign Application Priority Data

Jan. 2, 2020 (TW) ..... 109100059
Apr. 15, 2020 (TW) ..... 109112640

(51) Int. Cl.
*B25B 21/00* (2006.01)
*B25B 23/00* (2006.01)
*B25F 5/02* (2006.01)

(52) U.S. Cl.
CPC ..... *B25B 23/0028* (2013.01); *B25B 21/00* (2013.01); *B25F 5/02* (2013.01)

(58) Field of Classification Search
None
See application file for complete search history.

(56) References Cited

U.S. PATENT DOCUMENTS 4,346,630 A * 8/1982 Hanson ..... B25B 21/004 81/57.39
4,993,288 A * 2/1991 Anderson ..... B25B 13/463 81/57.39
2006/0053979 A1* 3/2006 Izumisawa ..... B25B 21/02 81/57.39
2007/0068346 A1* 3/2007 Izumisawa ..... B25B 23/108 81/57.39
2008/0178709 A1* 7/2008 Chen ..... B25B 23/0028 81/57.13
2016/0332287 A1* 11/2016 Chen ..... B25B 21/00
2022/0274233 A1* 9/2022 Wu ..... B25B 23/0028

* cited by examiner

*Primary Examiner* — Joseph J Hail
*Assistant Examiner* — Dana Lee Poon
(74) *Attorney, Agent, or Firm* — Muncy, Geissler, Olds & Lowe, P.C.

(57) ABSTRACT

A pneumatic wrench includes a handlebar having a main body, two extension walls defining an engagement notch therebetween, and a first air channel extending inside the main body and the two extension walls, and a tool head having a head portion, a neck portion extending from the head portion into the engagement notch, and a second air channel extending inside the head and neck portions. A pivot shaft is inserted through the handlebar and the tool head such that the tool head is swingable relative to the handlebar. The pivot shaft has a shaft body with a shaft hole, and two first and one second through holes in air communication with the shaft hole. The first air channel is communicated with the second air channel via the first and second through holes and the shaft hole. As such, the pneumatic wrench is angle-adjustable to fulfill user's need.

21 Claims, 11 Drawing Sheets

PNEUMATIC WRENCH

BACKGROUND OF THE INVENTION

1. Field of the Invention

The present invention relates generally to a pneumatic wrench and more particularly, to a pneumatic wrench which can adjust its angle in accordance with working conditions.

2. Description of the Related Art

A conventional pneumatic wrench is generally composed of a handlebar with an air inlet, a regulating knob, an air-driven motor, and an output shaft connected with the air-driven motor. The air inlet is in air communication with the air-driven motor, such that high-pressure air can be conducted to the air-driven motor via the air inlet to serve as the power source for driving the motor. By operating the regulating knob, the flow direction of the air entering into the air-driven motor can be changed, such that the output shaft can be driven to rotate clockwise or counterclockwise.

Though commercially available pneumatic wrenches have adopted lightweight structural design with the clockwise-and-counterclockwise rotation selectable function, the user will always need to adjust/change his/her wrist angle to enable alignment of the extending direction of the output shaft with a proper working position during actual operation because the extending direction of the output shaft is approximately perpendicular to the extending direction of the handlebar. This will deteriorate operational smoothness of the pneumatic wrench and is liable to cause occupational injury to users. Further, some commercially available wrenches may not be able to adjust their angle in narrow working spaces, resulting in failure of working. Therefore, how to improve the aforesaid disadvantages becomes a technical issue to be solved by skill persons in the art.

Further, because conventional pneumatic wrenches are usually configured in a way that the tool head and the handlebar are stationary with respect to each other, users may not smoothly press the on/off switch of the pneumatic wrench at an appropriate operational angle due to the narrow working environment or some obstacles, resulting in inconvenience in working. To solve the aforesaid issue, pneumatic wrenches having a handlebar rotatable relative to a tool head have been developed, such that users can adjust the pneumatic wrench to a desired angle that fits the working environment, thereby facilitating working. However, though the handlebar of the aforesaid pneumatic wrenches is rotatable relative to the tool head, the rotational angle is extremely limit, for example the handlebar can rotate about its axis at a maximum angle of 45 degrees. That is, users cannot freely determine the rotational angle, such that processing works performed by the conventional angle adjustable pneumatic wrenches may still be restricted by the working environment. In another aspect, in the design of the conventional angle adjustable pneumatic wrench, users must loosen a positioning member that is disposed between the tool head and the handlebar before rotating the handlebar, and in the other hand the users must tighten the positioning member after the handlebar has been rotated to a desired angle for proceeding with working. The aforesaid operational procedure of rotation of the handlebar, as well as the structure of the pneumatic wrench, is complicated.

SUMMARY OF THE INVENTION

The present invention has been accomplished in view of the above-noted circumstances. It is an objective of the present invention to provide a pneumatic wrench whose angle can be flexibly adjusted in accordance with user's need, thereby enhancing operational smoothness.

Another objective of the present invention is to provide a pneumatic wrench whose angle can be flexibly adjusted in accordance with environmental working condition, thereby enhancing applicable tolerance.

Still another objective of the present invention is to provide a pneumatic wrench whose handlebar can be freely rotated relative to the tool head in accordance with user's need with a convenient operational procedure in rotation of the handlebar and a simplified structure of the pneumatic wrench.

To attain the above-mentioned objectives, the present invention provides a pneumatic wrench comprising a handlebar, a tool head, and a pivot shaft. The handlebar includes a main body, two extension walls spacedly extending from an end of the main body, an engagement notch formed between the two extension walls, a first air channel extending inside the main body and the two extension walls, and two first pivot holes respectively penetrating through the two extension walls, respectively, in air communication with the first air channel. The tool head includes a head portion, a neck portion extending from the head portion into the engagement notch, a second air channel extending inside the head portion and the neck portion, and a second pivot hole penetrating through the neck portion in air communication with the second air channel. The pivot shaft is inserted into the two first pivot holes of the handlebar and the second pivot hole of the tool head such that the tool head is swingable relative to the handlebar. The pivot shaft includes a shaft body, a shaft hole extending inside the shaft body, two first annular grooves provided at an outer periphery of the shaft body at positions corresponding to the two extension walls respectively, a second annular groove provided at the outer periphery of the shaft body at a position corresponding to the neck portion, two first through holes provided at the shaft body and located at the two first annular grooves respectively in air communication with the shaft hole, and a second through hole provided at the shaft body and located at the second annular groove in air communication with the shaft hole, such that the first air channel of the handlebar is in air communication with the second air channel of the tool head via the two first annular grooves, the two first through holes, the shaft hole and the second through hole. As a result, the angle of the pneumatic wrench can be adjusted in accordance with the user's need, thereby enhancing the operational smoothness and the applicable tolerance of the pneumatic wrench.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
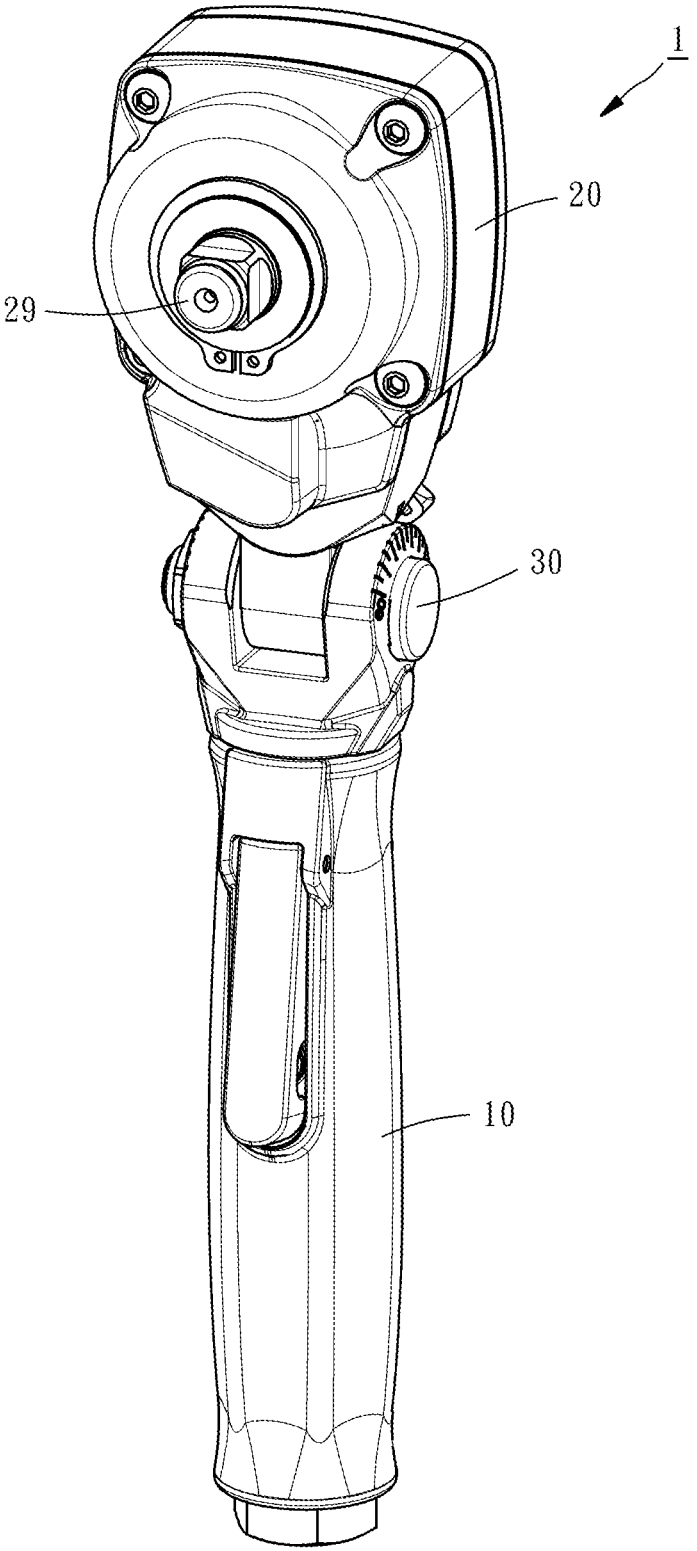
FIG. 1 is a perspective view of a pneumatic wrench according to a first embodiment of the present invention.
Figure 2:
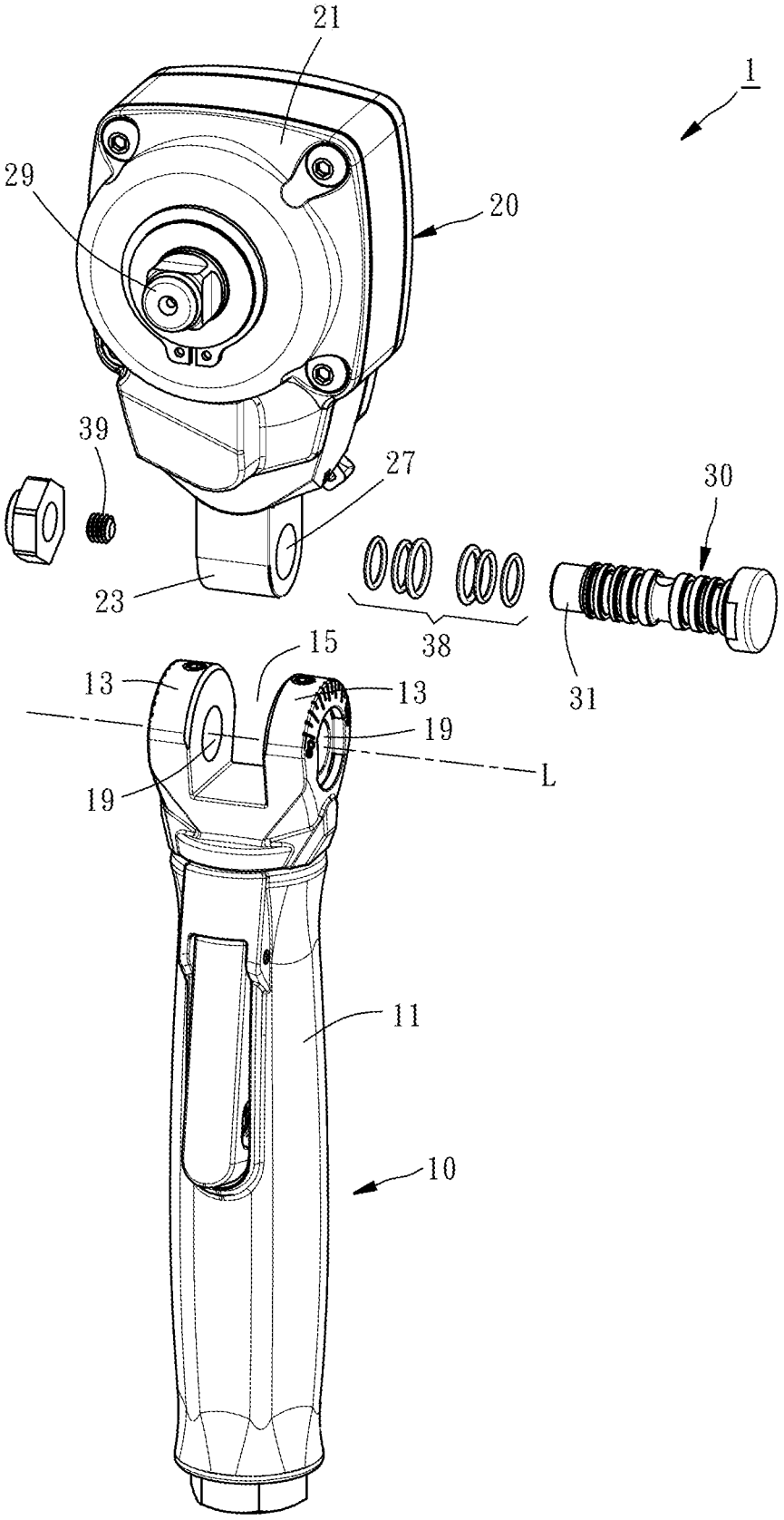
FIG. 2 is an exploded perspective view of the pneumatic wrench of the first embodiment of the present invention.

Hereunder two embodiments will be detailedly described with accompanying drawings for illustrating technical features and structure of the present invention. Referring to FIGS. 1 and 2, a pneumatic wrench 1 provided in accordance with a first embodiment of the present invention comprises a handlebar 10, a tool head 20, and a pivot shaft 30 inserted through the handlebar 10 and the tool head 20.

Figure 3:
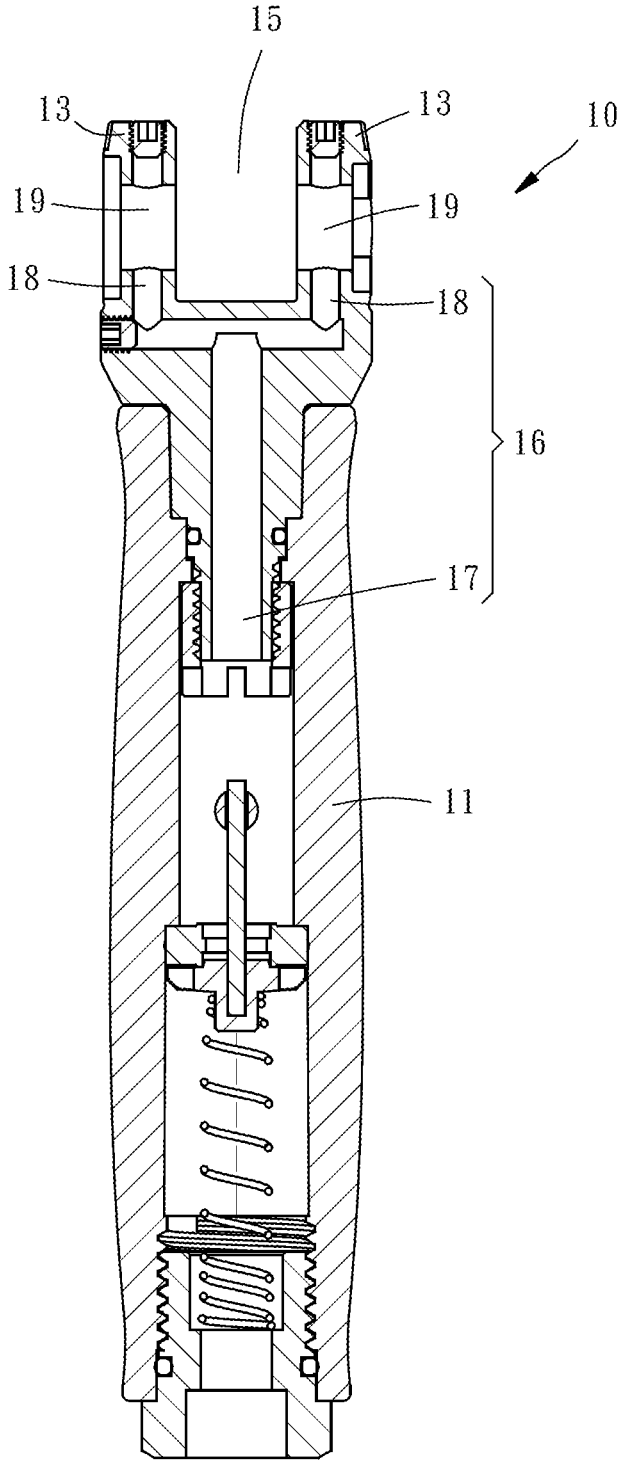
FIG. 3 is a cross-sectional view of a handlebar of the pneumatic wrench of the first embodiment of the present invention.

Referring to FIGS. 1-2 as well as FIG. 3, the handlebar 10 includes a rod-like main body 11, two extension walls 13 extending from a top end of the main body 11 and spaced from each other, an engagement notch 15 formed between the two extension walls 13, a first air channel 16 disposed in insides of the main body 11 and the two extension walls 13, and two first pivot holes 19 horizontally penetrating through the two extension walls 13, respectively, in air communication with the first air channel 16. Further, the first air channel 16 includes a main passage 17 and two bifurcate passages 18. The main passage 17 extends upwardly from a bottom end of the main body 11. The two bifurcate passages 18 are connected with a top end of the main passage 17 in a way that the two bifurcate passages 18 are both in air communication with the main passage 17 and extend from the main body 11 to the two extension walls 13, respectively. Each of the two bifurcate passages 18 is in air communication with one of the first pivot holes 19. The two first pivot holes 19 are aligned with each other in an imaginary pivot axis L which is substantially perpendicular to an extending direction of the main body 11.

Figure 4:
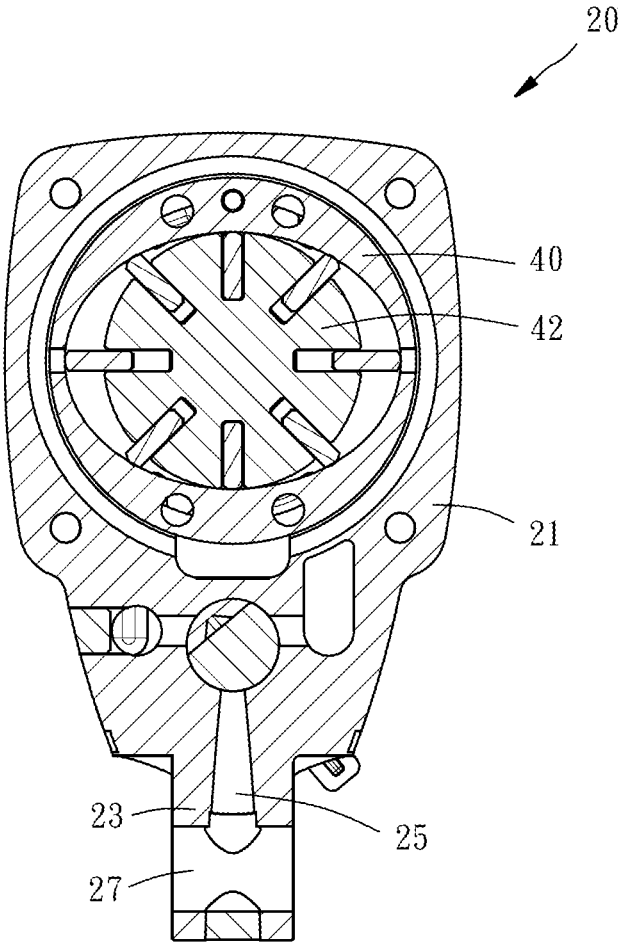
FIG. 4 is a cross-sectional view of a tool head of the pneumatic wrench of the first embodiment of the present invention.

Referring to FIGS. 1-3 as well as FIG. 4, the tool head 20 includes a head portion 21, a neck portion 23 extending downwardly from the head portion 21 into the engagement notch 15, a second air channel 25 disposed in insides of the head portion 21 and the neck portion 23, a second pivot hole 27 horizontally penetrating through the neck portion 23 in air communication with the second air channel 25, an output shaft 29 extending from the head portion 21 toward a forward direction, and an air-driven motor 40 disposed inside the head portion 21 and connected with the output shaft 29. The second air channel 25 extends upwardly in a way that the second air channel 25 is in air communication with the air-driven motor 40. As such, the output shaft 29 is drivenable by the air-driven motor 40 to rotate. It is defined in this embodiment that a zero degree represents the tool head 20 is parallel to the main body 11 of the handlebar 10. In this embodiment, the tool head 20 is swingable relative to the handlebar 10 in an angle range from −60 degrees to 60 degrees, namely swingable forward or backward relative to the handlebar 10.

Figure 5:
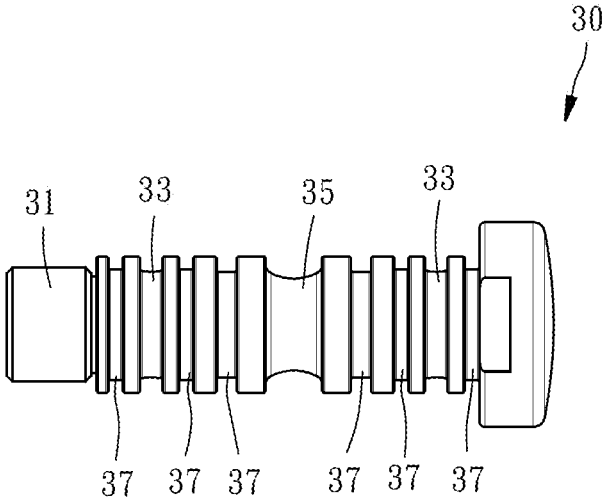
FIG. 5 is a front view of a pivot shaft pf the pneumatic wrench of the first embodiment of the present invention.
Figure 6:
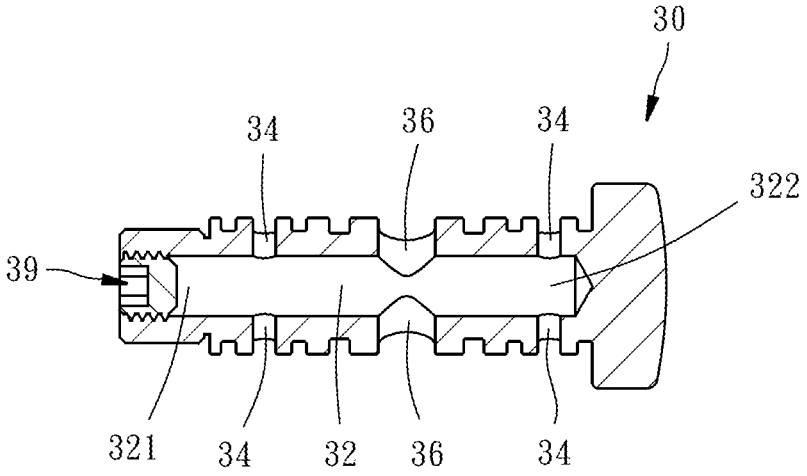
FIG. 6 is a cross-sectional view of the pivot shaft of the pneumatic wrench of the first embodiment of the present invention.

As shown in FIGS. 5 and 6, the pivot shaft 30 is inserted into the two first pivot holes 19 of the handlebar 10 and the second pivot hole 27 of the tool head 20, such that the tool head 20 is swingable relative to the handlebar 10 forward and backward. That is, the tool head 20 is pivotally connected with the handlebar 10 by the pivot shaft 10. In the process that the tool head 20 swings relative to the handlebar 10, an extension direction of the output shaft 29 changes relative to the pivot shaft 30. The pivot shaft 30 includes a shaft body 31, a shaft hole 32 extending inside the shaft body 31, two first annular grooves 33 provided at an outer periphery of the shaft body 31 at positions corresponding to the two extension walls 13 respectively, a second annular groove 35 provided at the outer periphery of the shaft body 31 at a position corresponding to the neck portion 23, four first through holes 34 provided at the shaft body 31 and located at the two first annular grooves 33 respectively, two second through holes 36 provided at the shaft body 31 and located at the second annular groove 35, and six third annular grooves 37 provided at the outer periphery of the shaft body 31. An extending direction, namely a first direction, of the shaft body 31 of the pivot shaft 30 is perpendicular to an extending direction, namely a second direction, of the main body 11 of the handlebar 10. The shaft hole 32 is recessed inwardly from an end of the shaft body 31 of the pivot shaft 30 in a way that the shaft hole 32 has an opened end 321, namely the left side end, and a closed end 322, namely the right side end, opposite to the opened end 321, as shown in FIG. 6. All of the first through holes 34 and the second through holes 36 are in air communication with the shaft hole 32. The four first through holes 34 are arranged as two pairs located at the two first annular grooves 33, respectively. The two first through holes 34 in a same pair are axially aligned in a line with each other. The two second through holes 36 are located at the second annular groove 35 and axially aligned in a line with each other. The six third grooves 37 are arranged at two lateral sides of the first annular grooves 33 and the second annular groove 35. Further, a plug 39 is inserted into the opened end 321 of the shaft hole 32 to block the opened end 321, such that the left side and right side ends of the shaft hole 32 are both closed. In another embodiment, the left side and right side ends of the shaft hole 32 may be configured as being closed ends directly. In such circumstance, the plug 39 can be omitted.

It is to be mentioned that in this embodiment, the positions of the first through holes 34 correspond to the two bifurcate passages 18, and the positions of the second through holes 36 correspond to the second air channel 25. In another embodiment, the amounts and positions of the first through holes 34 and the second through holes 36 may be modified, i.e. may not be limited to those of the present embodiment. For example, the pneumatic wrench of the present invention may comprise two or more first through holes 34, which are located at the first annular grooves 33 respectively, and one or more second through holes 36, which are located at the second annular groove 35, as well as the first annular grooves 33 correspond in position to the bifurcate passages 18 and the second annular groove 35 corresponds in position to the second air channel 25 so as to enable that the working air can flow from the two bifurcate passages 18 of the handlebar 10 to the second air channel 25 of the tool head 20.

In this embodiment, to avoid air leak from left and right lateral sides of the first annular grooves 33 and the second annular groove 35, the pneumatic wrench 1 further comprises six air seals 38 sleeved onto the shaft body 31 of the pivot shaft 30 and received respectively in the third annular grooves 37 in a way that the outer peripheries of the air seals 38 are tightly abutted against the hole walls of the first pivot holes 19 and the second pivot hole 27.

Figure 7:
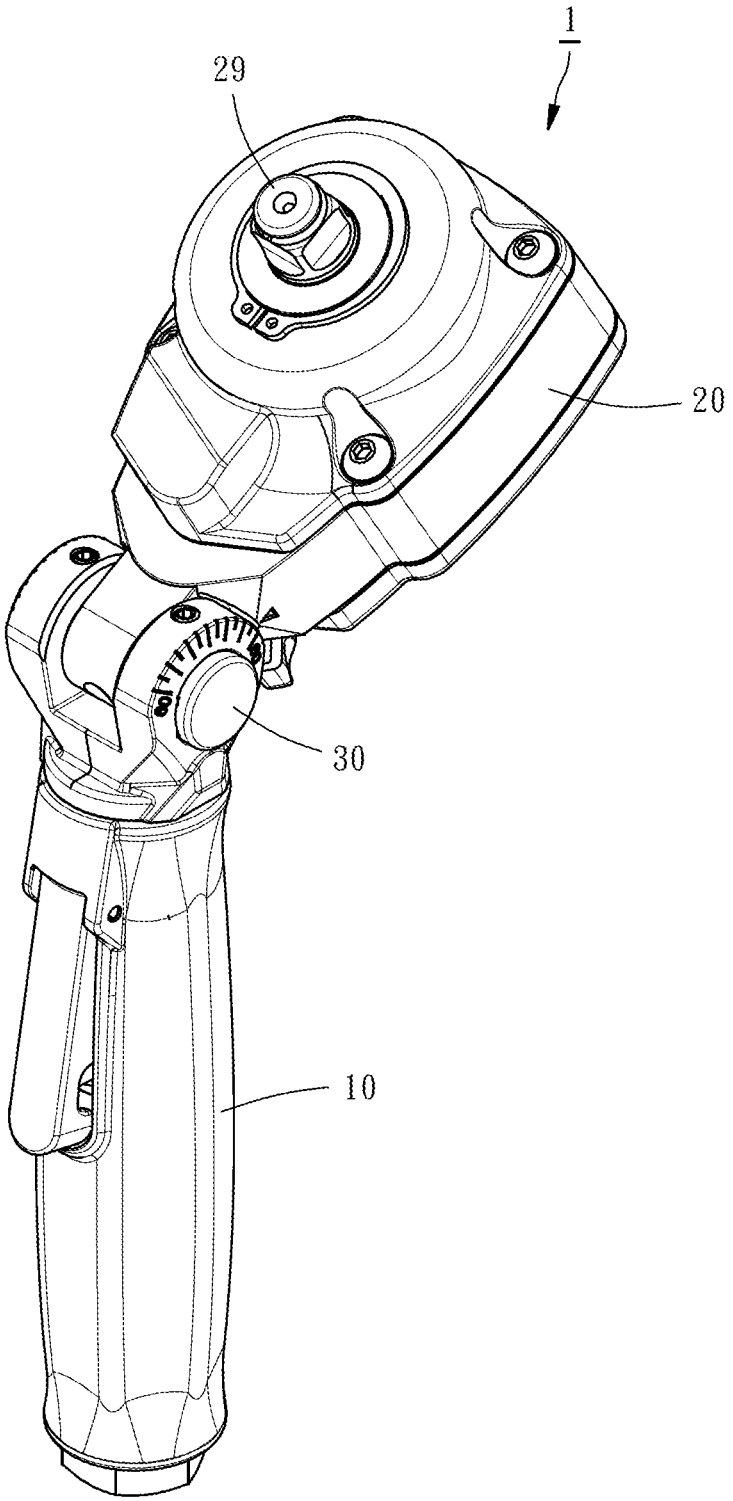
FIG. 7 is another perspective view of the pneumatic wrench of the first embodiment of the present invention, showing the tool head is swung relative to the handlebar at an angle.

FIG. 7 shows that the tool head 20 is swung relative to the handlebar 10 at an angle of 60 degrees. In actual operation, high-pressure air will flow along the main passage 17 and the bifurcate passages 18 of the first air channel 16, then pass through the two first annular grooves 33 and the first through holes 34 into the shaft hole 32, and then flow, from the shaft hole 32, through the second through holes 36 and the second annular groove 25 into the second air channel 25 of the toll head 20 to drive the rotor 42 of the air-driven motor 40 that is located inside the head portion 21 of the tool head 20 to rotate. Since the air flows to first through holes 34 via the first annular grooves 33 and to the second air channel 25 of the tool head 20 via the second annular groove 35, the air will always be smoothly supplied from the handlebar 10 to the air-driven motor 40 of the tool head 20 no matter the tool head 20 is swung relative to the handlebar at which angle. As a result, the tool head 20 of the pneumatic wrench 1 can be flexibly adjusted to a desired angle in accordance with the user's need or the environmental working condition, thereby enhancing not only operation smoothness but also applicable tolerance because the pneumatic wrench 1 can be adaptively operated in various environments, especially in a narrow working space.

Based on the above-mentioned technical features, various modifications to the structure of the pneumatic wrench 1 may be made. For example, the structure of the first air channel 16 may be modified, and the tool head 20 may be configured as being swingable relative to the handlebar 10 within an angle range from −90 degrees to 90 degrees. Further, the number of the air seals 38 may not be limited to that of the present embodiment. Alternatively, the third annular grooves 37 and/or the air seals 38 may be omitted.

Figure 8:
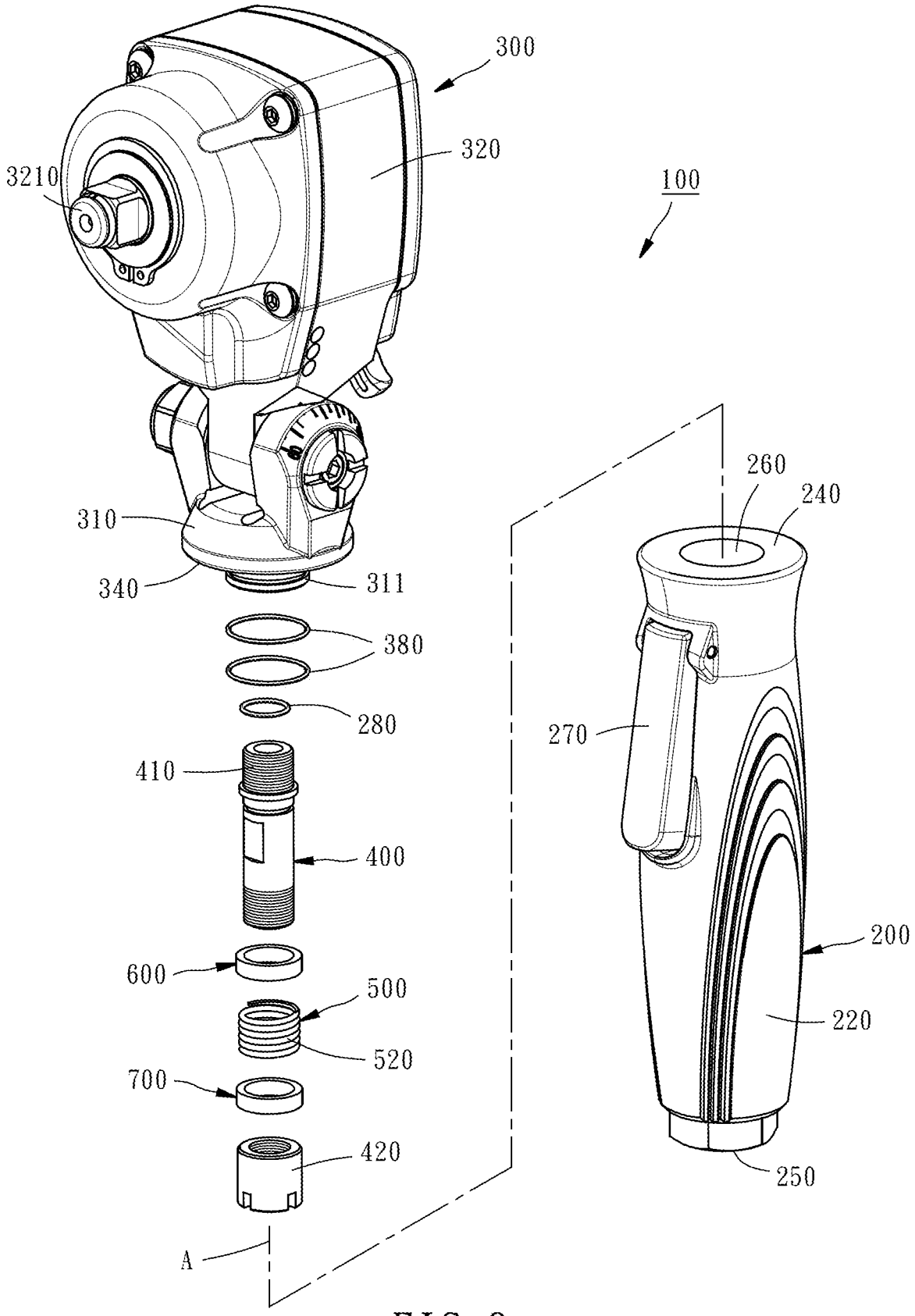
FIG. 8 is an exploded perspective view of a pneumatic wrench according to a second embodiment of the present invention.

Referring to FIG. 8, a pneumatic wrench 100 provided in accordance with a second embodiment of the present invention comprises a handlebar 200, a tool head 300, a tube member 400, a compression spring 500, an upper washer 600, and a lower washer 700.

Figure 9:
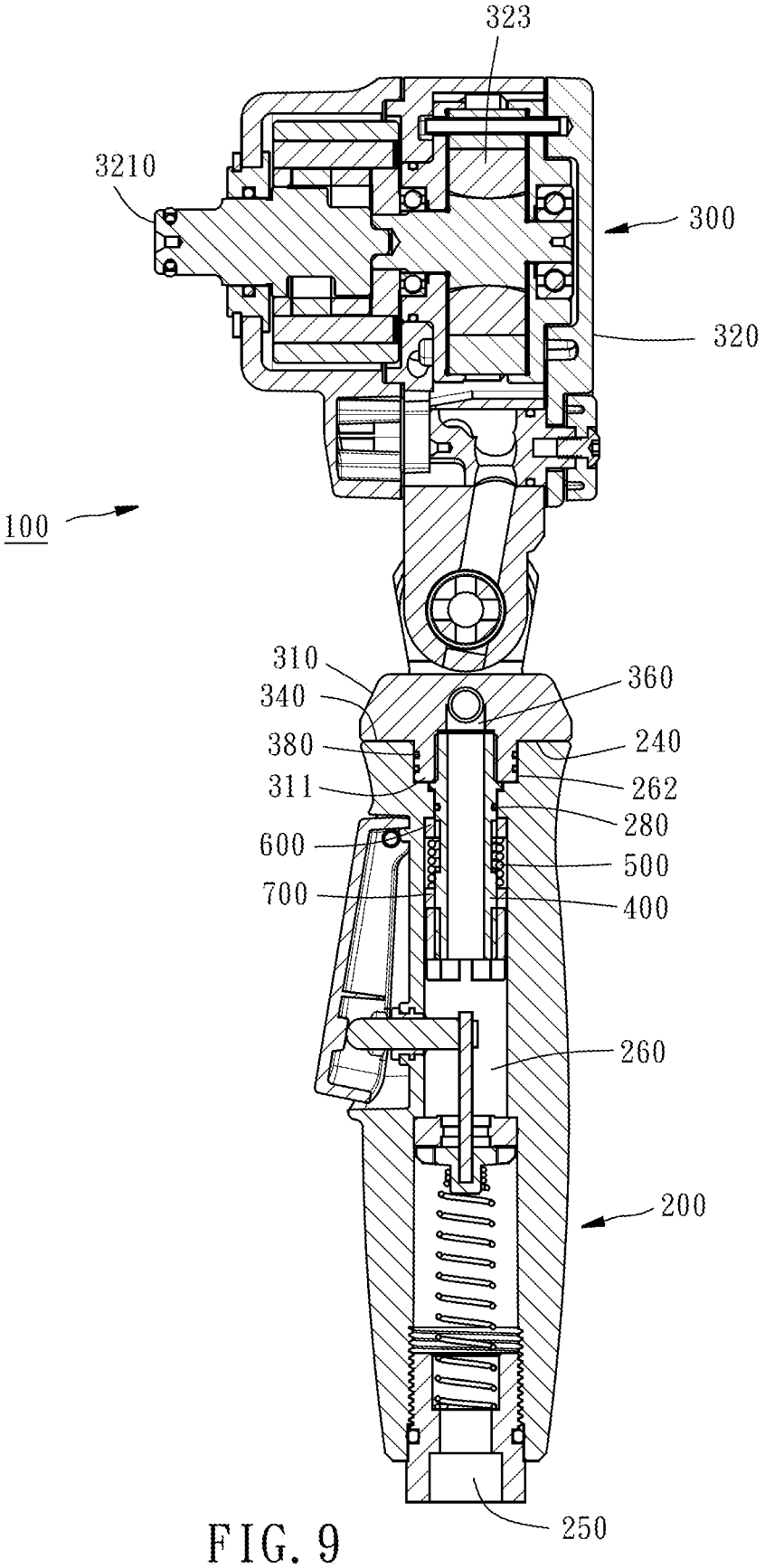
FIG. 9 is a cross-sectional view of the pneumatic wrench of the second embodiment of the present invention, showing the pneumatic wrench is in a state of use under the status that air does not enter into the pneumatic wrench.
Figure 10:
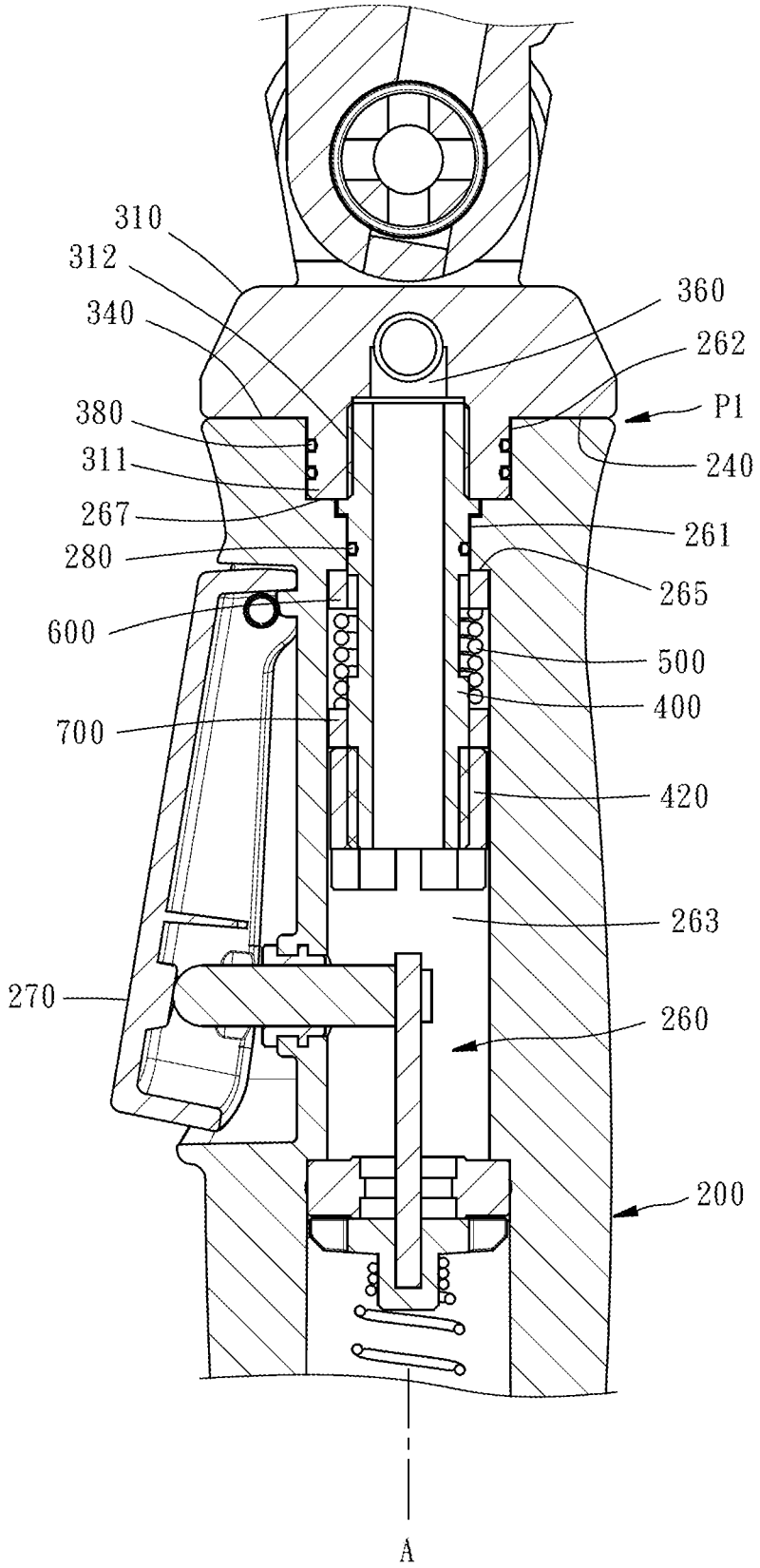
FIG. 10 is an enlarged view of a part of FIG. 9.
Figure 11:
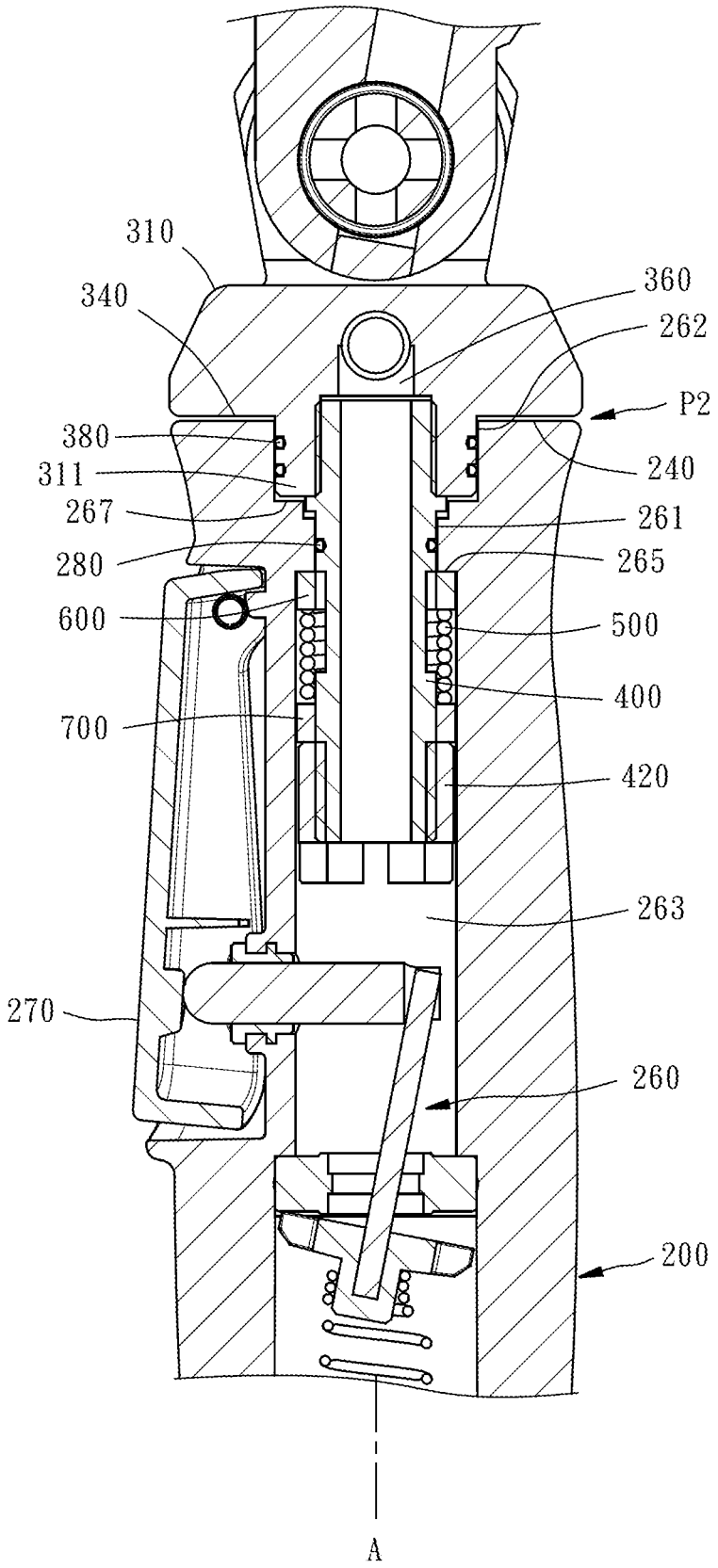
FIG. 11 is a schematic cross-sectional view of the pneumatic wrench of the second embodiment of the present invention, showing the pneumatic wrench is in a state of use under the status that air enters into the pneumatic wrench.

The handlebar 200 comprises a cylindric grip member 220 and a connection member 310. The grip member 220 is provided at a top end thereof with a first annular contact surface 240 and at a bottom end thereof with an air inlet 250. The handlebar 200 further includes a lower air channel 260 penetrating through the grip member 220 and being in air communication with the air inlet 250, a press button 270, and an air seal 280. Referring further to FIGS. 9 and 10, the lower air channel 260 of the grip member 220 includes a neck section 261, an upper chamber 262 in air communication with the neck section 261, a lower chamber 263 in air communication with the neck section 261, a shoulder 265 located between the neck section 261 and the lower chamber 263, and a step portion 267 located between the neck section 261 and the upper chamber 262. In this embodiment, the air seal 280 is sleeved onto the tube member 400 and located between the neck section 261 of the lower air channel 260 and the tube member 400 so as to avoid air leak. In another feasible embodiment, the number of the air seal 280 is not limited to that of the present embodiment, and the air seal 280 can be sleeved onto other location of the tube member 400. Before the press button 270 is pressed, as shown in FIG. 10, external air cannot enter into the lower air channel 260. After the press button 270 is pressed, as shown in FIG. 11, the external air can flow from bottom to top into the lower air channel 260 via the air inlet 250.

Referring to FIGS. 8 and 9, the connection member 310 includes an extension tube 311, a second annular contact surface 340 at a bottom end of the connection member 310, and an upper air channel 360 extending upwardly from the bottom end of the connection member 310, and two air seals 380. The extension tube 311 downwardly extends into the upper chamber 262 of the lower air channel 260 of the grip member 220 in a way that the extension tube 311 is connected with the tube member 400. The tool head 300 includes a swing portion 320 pivotally connected with the upper end of the connection member 310. The swing portion 320 is provided with an output shaft 3210, and an air-driven motor 323 connected with the output shaft 3210. The upper air channel 360 extends upwardly in air communication with the air-driven motor 323, such that the output shaft 3210 can be driven by the air-driven motor 323 to rotate. The two air seals 380 are sleeved onto the extension tube 311 and located between the upper chamber 262 and the extension tube 311 so as to avoid air leak. In another feasible embodiment, the number of the air seals 380 is not limited to that of the present embodiment. The connection member 310, as well as the tool head 300, is moveable between a contact position P1, as shown in FIG. 10, and a non-contact position P2, as shown in FIG. 11, relative to the grip member 220. In addition, the swing portion 320 is swingable relative to the connection member 310. For example, in the viewing angle of FIG. 9, the swing portion 320 can swing relative to the connection member 310 leftward and rightward. In another feasible embodiment, the swing portion 320 may be fixedly connected with the connection member 310, i.e. the portion 320 is configured as not being swingable relative to the connection member 310.

Referring to FIGS. 8-10, a first end of the tube member 400, namely the upper end of the tube member 400 when it is viewed along the viewing angle of FIG. 8, is disposed with the extension tube 311 of the connection member 310 in air communication with the upper air channel 360, and a second end of the tube member 400, namely the bottom end of the tube member 400 when it is viewed along the viewing angle of FIG. 8, extends into the lower air channel 260 of the grip member 220 in air communication with the lower air channel 260. Specifically, the extension tube 311 has an internal threaded portion 312, and the tube member 400 has an external threaded portion 410 engaged with the internal threaded portion 312. However, the connecting way of the extension tube 311 with the tube member 400 is not limited. For example, the extension tube 311 can be integrally formed with the tube member 400 or connected with the tube member 40 by welding or embedded fastening. As such, by means of the air communication of the tube member 400, the upper air channel 360 and the lower air channel 260 can form the first air channel 16 as being disclosed in the first embodiment. The tube member 400 is provided at an outer periphery thereof with a flange 420. The aforesaid air seal 280 may be sleeved onto the flange 420. In the present embodiment, the flange 420 is realized by a nut screwingly threaded onto the outer periphery of the tube member 400 and located at the bottom end of the tube member 400. In another feasible embodiment, the flange 420 may be integrally formed with the tube member 400. Further, the tube member 400 defines a tube axis A thereof. The tube axis A of the tube member 400 is substantially perpendicular to the first annular contact surface 240 of the grip member 220 and the second annular contact surface 340 of the connection member 310. The connection member 310 is moveable along the tube axis A between the contact position P1 and the non-contact position P2 relative to the grip member 220.

The compression spring 500 is received inside the lower air channel 260 of the grip member 220. Specifically, the compression spring 500 is sleeved onto the tube member 400 and located in the lower chamber 263 of the lower air channel 260 in a way that the compression spring 500 has two ends directly or indirectly abutted against the flange 420 of the tube member 400 and the shoulder 265 of the lower air channel 260, respectively. Because the upper end of the compression spring 500 is fixedly restricted by the shoulder 265, the compression spring 500 will thus impart, via the flange 420, a downward force on the tube member 400 in a way that the tube member 400 drives the connection member 310 and the tool head 300 to move towards the contact position P1. In other words, in a normal status without interference by any external force, the connection member 310 will stay at the contact position P1, and the adjacent coils 520 of the compression spring 500 are not completely abutted together.

The upper washer 600 is sleeved onto the tube member 400 and located between the compression spring 500 and the shoulder 265 of the lower air channel 260. While the lower washer 700 is sleeved onto the tube member 400 and located between the compression spring 500 and the flange 420 of the tube member 400. It is to be understood that in this embodiment, the upper end of the compression spring 500 is stopped at the upper washer 600, and the upper washer 600 is further stopped at the shoulder 265. While the lower end of the compression spring 500 is stopped at the lower washer 700, and the lower washer 700 is further stopped at the flange 420. In other words, the two ends of the compression spring 500 are indirectly abutted against the shoulder 265 and the flange 420, respectively. The purpose of installing the upper and lower washers 600 and 700 is to compensate tolerance or to avoid friction. However, in another feasible embodiment, the upper washer 600 and/or the lower washer 700 can be omitted. In such a circumstance, the two ends of the compression spring 500 are directly abutted against the shoulder 265 and the flange 420, respectively.

Figure 12:
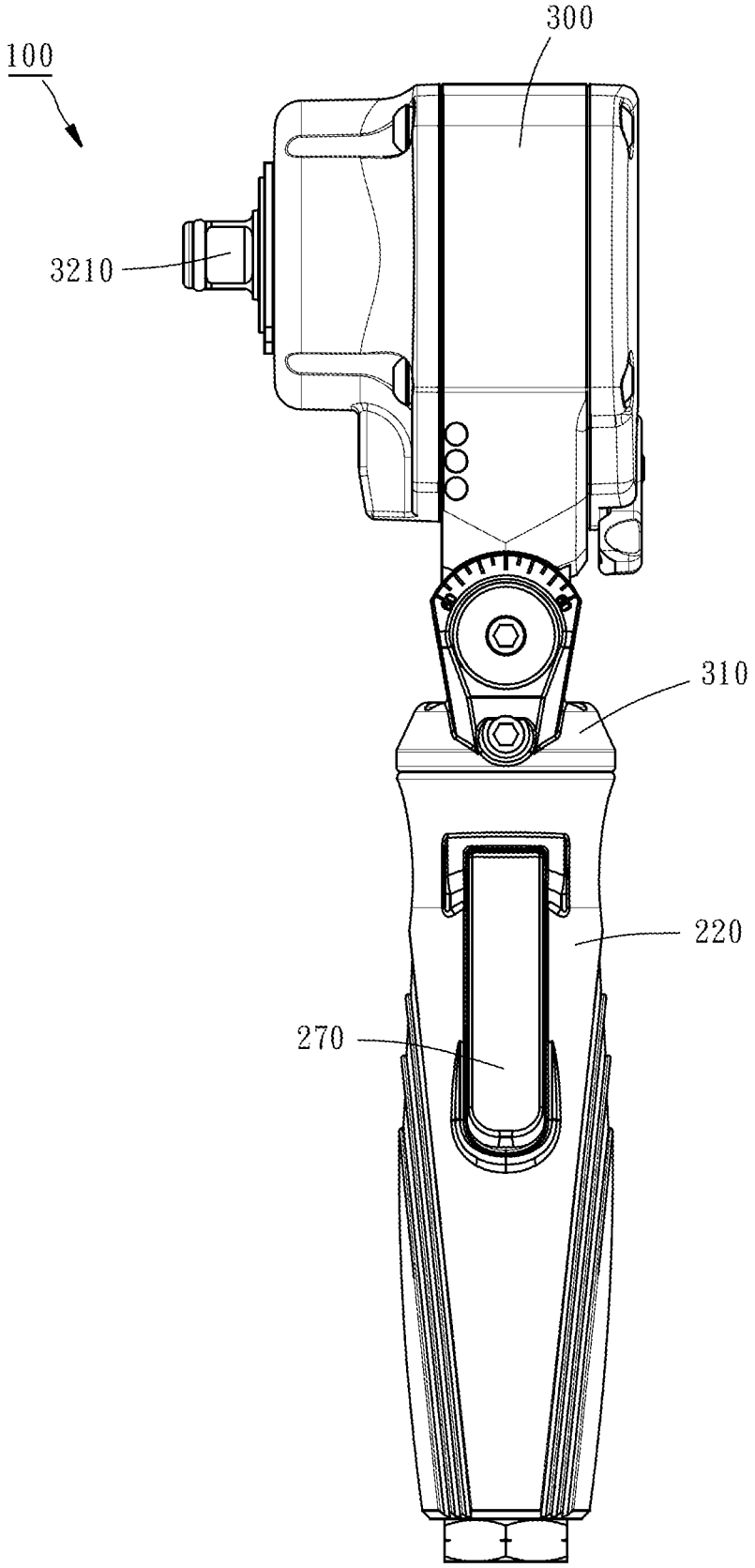
FIG. 12 is a schematic view of the pneumatic wrench of the second embodiment of the present invention, showing that a grip member is turned relative to a tool head at an angle of 90 degrees.

In actual operation, a user may press the press button 270, as shown in FIG. 11, to enable external air to enter the lower air channel 26 through the air inlet 250 and then upwardly flow into the upper air channel 360 to drive the air-driven motor 323 to rotate, which in turn drives the output shaft 3210 to rotate for working. In a normal status, no matter whether the press button 270 is pressed, the compression spring 500 imparts a force on the tube member 400 to force the connection member 310 to move toward the contact position P1. At this status, the second annular contact surface 340 of the connection member 310 is abutted against the first annular contact surface 240 of the grip member 220 and the distal end of the extension tube 311 is abutted against the step portion 267 of the lower air channel 260. By means of the major friction force generated between the second annular contact surface 340 and the first annular contact surface 240 as well as the minor friction force generated between the extension tube 311 and the step portion 267, the grip member 220 will not be able to rotate about the tube axis A relative to the connection member 310 and the tool head 300 when the connection member 310 is located at the contact position P1. However, in a narrow working environment or in an operational position that does not allow user to work with a comfortable posture and angle, the user may pull the tool head 300 to move the connection member 310 from the contact position P1 to the non-contact position P2, such that the grip member 220 can rotate about the tube axis A relative to the connection member 310 and the tool head 300 to a desired angle. The detail operation of the rotation will be illustrated hereunder. The user may uses his/her one hand to hold the grip member 220 and the other hand to hold the tool head 300 or the connection member 310, and then pull the tool head 300 or the connection member 310 away from the grip member 220 to enable the connection member 310 to move along the tube axis A from the connect position P1 to the non-contact position P2. When the connection member 310 is located at the non-contact position P2, the second annular contact surface 340 is disengaged from the first annular contact surface 240, as shown sin FIG. 11, in a way that there is a gap of about 05 mm between the second annular contact surface 340 and the first annular contact surface 240, and the distal end of the extension tube 311 is also disengaged from the step portion 267. Without the resistance of the friction force, the grip member 220 can be turned about the tube axis A to rotate relative to the connection member 310 or the tool head 300 to any desired angle in accordance with the user's need. For example, FIG. 12 shows that the grip member 220 is turned relative to tool head 300 at an angle of 90 degrees. When the connection member 310 moves from the contact position P1 to the non-contact position P2, by means of the extension tube 311 the connection member 310 will also drive the tube member 400, the lower washer 700 and the flange 420 to move axially. As a result, the compression spring 500 is upwardly compressed by the flange 420 to a maximum compressed status that all of the adjacent coils of the compression spring 500 are abutted together, such that the connection member 310 is prohibited to further move away from the grip member 220, i.e. the connection member 310 is limited at an outmost position, so as to avoid possible air leak due to an undesired large gap between the second annular contact surface 340 and the first annular contact surface 240. It is to be mentioned that as soon as the second annular contact surface 340 is disengaged from the first annular contact surface 240, the grip member 220 will be able to rotate relative to the connection member 310 to any desired angle no matter how long the distance of the gap between the first and second annular contact surfaces 240 and 340 is. Therefore, the gap of about 0.5 mm between the second annular contact surface 340 and the first annular contact surface 240 is just an example for illustrating the technical feature of the present invention, not to be used to limit the present invention.

After the user turns the grip member 220 to rotate relative to the connection member 310 or the tool head 300 to a desired angle, as soon as the user releases his/her hand from the connection member 310 or the tool head 300, the connection member 310, which will be immediately driven by the rebound force of the compression spring 500, will move along the tube axis A from the non-contact position P2 back to the contact position P1 where the grip member 220 cannot rotate relative to the connection member 310 or the tool head 300 anymore. In a condition that the tool head 300 is engaged with a workpiece or workplace and thus fixed, the user may only use his/her one hand to pull the grip member 220 away from the connection member 310 or the tool head 300 so as to relatively move the connection member 310 to the non-contact position P2, such that the grip member 220 can be turned to rotate relative to the connection member 310 or the tool head 300 to a desired angle in accordance with the user's need.

In summary, the grip member 220 of the pneumatic wrench 100 can be rotated at any desired angle relative to the tool head 300 in accordance with the user's need, effectively solving the problem of a narrow working environment or an operational position that does not allow the user to work with a comfortable and/or convenient posture and angle. Further, the angle adjustment of the pneumatic wrench of the present invention can be operated simply and conveniently without the need of other complicated components, and can even be operated by one hand. Furthermore, the whole structure of the pneumatic wrench 100 is simple and light-weight and can be assembled easily, thereby lowering the manufacturing cost and having great market potential.

Based on the above-mentioned technical features, various modifications to the structure of the pneumatic wrench 100 may be made. For example, the extension tube 311 of the connection member 310 may be provided at the grip member 220, and the upper chamber 262 of the grip member 220 may be provided at the connection member 310. In such a circumstance, it would be that the extension tube of the grip member 220 upwardly extends into the upper chamber of the connection member 310. Alternatively, the step portion 267 of the lower air channel 260 may be omitted because when the connection member 310 is stayed at the contact position P1, the major friction force between the second annular contact surface 340 and the first annular contact surface 240 is sufficient to prohibit the grip member 220 from rotation relative to the tool head 300 even though the distal end of the extension tube 311 is not abutted against the step portion 267. Further, the shoulder 265 of the lower air channel 260 of the grip member 220 may be omitted, and in such a circumstance the inner wall of the lower air channel 260 may be provided with a taper structure being gradually narrowed upwardly for being directly or indirectly abutted by the upper end of the compression spring 500. Alternatively, the upper end of the compression spring 500 may be welded or fixedly engaged with the inner wall of the lower air channel 260 as long as the upper end of the compression spring 500 can be fixedly abutted against the lower air channel 260 of the grip member 220. Any possible way for fixedly connecting an end of the compression spring 500 with the lower air channel 260 can be used in the present invention. In another aspect, the first annular contact surface 240 of the grip member 220 and the second annular contact surface 340 of the connection member 310 may configured as not being perpendicular to the tube axis A. For example, one of the first annular contact surface 240 and the second annular contact surface 340 may be configured as being a convex cone surface and the other as being a concave cone surface complementary to the convex cone surface, or the first annular contact surface 240 and the second annular contact surface 340 may be configured as having other shapes or structures.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A pneumatic wrench, comprising:

a handlebar (10) including a main body (11), two extension walls (13) spacedly extending from an end of the main body (11), an engagement notch (15) formed between the two extension walls (13), a first air channel (16) extending inside the main body (11) and the two extension walls (13), and two first pivot holes (19) respectively penetrating through the two extension walls (13) in air communication with the first air channel (16);

a tool head (20) including a head portion (21), a neck portion (23) extending from the head portion (21) into the engagement notch (15), a second air channel (25) extending inside the head portion (21) and the neck portion (23), and a second pivot hole (27) penetrating through the neck portion (23) in air communication with the second air channel (25); and a pivot shaft (30) inserted into the two first pivot holes (19) of the handlebar (10) and the second pivot hole (27) of the tool head (20) such that the tool head (20) is swingable relative to the handlebar (10), the pivot shaft (30) including a shaft body (31), a shaft hole (32) extending inside the shaft body (31), two first annular grooves (33) provided at an outer periphery of the shaft body (31) at positions corresponding to the two extension walls (13) respectively, a second annular groove (35) provided at the outer periphery of the shaft body (31) at a position corresponding to the neck portion (23), two first through holes (34) provided at the shaft body (31) and located at the two first annular grooves (33) respectively in air communication with the shaft hole (32), and a second through hole (36) provided at the shaft body (31) and located at the second annular groove (35) in air communication with the shaft hole (32), such that the first air channel (16) of the handlebar (10) is in air communication with the second air channel (25) of the tool head (20) via the two first annular grooves (33), the two first through holes (34), the shaft hole (32) and the second through hole (36).

2. The pneumatic wrench as claimed in claim 1, further comprising a plurality of air seals (38) sleeved onto the shaft body (31) of the pivot shaft (30) and located at two lateral sides of each of the two first annular grooves (33) and two lateral sides of the second annular groove (35).

3. The pneumatic wrench as claimed in claim 2, wherein the shaft body (31) of the pivot shaft (30) is provided with a plurality of third annular grooves, in each of which one of the air seals (38) is received.

4. The pneumatic wrench as claimed in claim 1, wherein the shaft hole (32) is recessed from an end of the shaft body (31) of the pivot shaft (30) in a way that the shaft hole (32) has an opened end (321) and a closed end (322) opposite to the opened end (321); a plug (39) is inserted into the opened end (321) of the shaft hole (32) to block the opened end (321) of the shaft hole (32).

5. The pneumatic wrench as claimed in claim 1, wherein the shaft body (31) of the pivot shaft (30) extends in a first direction and the main body (11) of the handlebar (10) extends in a second direction perpendicular to the first direction.

6. The pneumatic wrench as claimed in claim 1, wherein the first air channel (16) comprises a main passage (17) and two bifurcate passages (18); the main passage (17) extends from an end of the main body (11); the two bifurcate passages (18) are in air communication with the main passage (17) and extend from the main body (11) to the two extension walls (13), respectively.

7. The pneumatic wrench as claimed in claim 1, wherein the tool head (20) comprises an output shaft (29) extending from the head portion (21); an extension direction of the output shaft (29) changes relative to the pivot shaft (30) when the tool head (20) swings relative to the handlebar (10).

8. The pneumatic wrench as claimed in claim 1, wherein the tool head (20) is swingable relative to the handlebar (10) in an angle range from −90 degrees to 90 degrees.

9. The pneumatic wrench as claimed in claim 8, wherein the tool head (20) is swingable relative to the handlebar (10) in the angle range from −60 degrees to 60 degrees.

10. The pneumatic wrench as claimed in claim 1, wherein the handlebar (200) comprises a grip member (220) and a connection member (310); the grip member (220) includes a first annular contact surface (240) and a lower air channel (260) penetrating through the grip member (220); the connection member (310) includes a second annular contact surface (340) and an upper air channel (360); the connection member (310) is configured as being moveable between a contact position (P1) and a non-contact position (P2) relative to the grip member (220); when the connection member (310) is located at the contact position (P1), the second annular connect surface (340) is in contact with the first annular contact surface (240); when the connection member (310) is located at the non-contact position (P2), the second annular connect surface (340) is not in contact with the first annular contact surface (240); the pneumatic wrench further comprises a tube member (400) and a compression spring (500); the tube member (400) has a first end disposed with the connection member (310) in air communication with the upper air channel (360), and a second end extending into the lower air channel (260) of the grip member (220) in air communication with the lower air channel (260); the upper air channel (360), the lower air channel (260), and the tube member (400) form the first air channel (16); the compression spring (500) is received in the lower air channel (260) of the grip member (220) and imparts a force on the tube member (400) in a way that the tube member (400) drives the connection member (310) to move towards the contact position (P1); the compression spring (500) has a plurality of coils (520); when the connection member (310) is located at the non-contact position (P2), each two adjacent said coils (520) of the compression spring (500) are abutted with each other.

11. The pneumatic wrench as claimed in claim 10, wherein at least one air seal (280) is disposed between the lower air channel (260) of the grip member (220) and the tube member (400).

12. The pneumatic wrench as claimed in claim 10, wherein the lower air channel (260) of the grip member (220) includes a neck section (261), a lower chamber (263) in air communication with the neck section (261), and a shoulder (265) located between the neck section (261) and the lower chamber (263); the tube member (400) is provided at an outer periphery thereof with a flange (420); the compression spring (500) is sleeved onto the tube member (400) and located in the lower chamber (263) in a way that the compression spring (500) has two ends abutted against the flange (420) of the tube member (400) and the shoulder (265) of the lower air channel (260), respectively.

13. The pneumatic wrench as claimed in claim 12, wherein the tube member (400) defines a tube axis (A) thereof; the tube axis (A) of the tube member (400) is perpendicular to the first annular contact surface (240) of the grip member (220) and the second annular contact surface (340) of the connection member (310).

14. The pneumatic wrench as claimed in claim 13, wherein the connection member (310) is configured as being moveable along the tube axis (A) of the tube member (400) between the contact position (P1) and the non-contact position (P2) relative to the grip member (220).

15. The pneumatic wrench as claimed in claim 12, wherein the flange (420) is formed by a nut screwingly threaded onto the tube member (400).

16. The pneumatic wrench as claimed in claim 12, further comprising an upper washer (600) sleeved onto the tube member (400) and located between the compression spring (500) and the shoulder (265) of the lower air channel (260).

17. The pneumatic wrench as claimed in claim 12, further comprising a lower washer (700) sleeved onto the tube member (400) and located between the compression spring (500) and the flange (420) of the tube member (400).

18. The pneumatic wrench as claimed in claim 10, wherein the lower air channel (260) of the grip member (220) includes a neck section (261) and an upper chamber (262) in air communication with the neck section (261); the connection member (310) includes an extension tube (311) extending into the upper chamber (262) in a way that the extension tube (311) is connected with the tube member (400).

19. The pneumatic wrench as claimed in claim 18, wherein the extension tube (311) has an internal threaded portion (312); the tube member (400) has an external threaded portion (410) engaged with the internal threaded portion (312).

20. The pneumatic wrench as claimed in claim 18, wherein the lower air channel (260) of the grip member (220) includes a step portion (267) located between the neck section (261) and the upper chamber (262); when the connection member (310) is located at the contact position (P1), a terminal end of the extension tube (311) is abutted against the step portion (267) of the lower air channel (260).

21. The pneumatic wrench as claimed in claim 18, wherein at least one air seal (280) is disposed between the upper chamber channel (262) and the extension tube (311).

* * * * *